United States Patent [19]

Beavan et al.

[11] 4,293,642

[45] Oct. 6, 1981

[54] IN PHOTOGRAPHIC EMULSION ADHESION TO A POLYESTER FILM BASE

[75] Inventors: Elton L. Beavan, Binghamton, N.Y.; E. Bradley Moynahan, Saratoga, Calif.

[73] Assignee: GAF Corporation, New York, N.Y.

[21] Appl. No.: 149,355

[22] Filed: May 13, 1980

[51] Int. Cl.[3] ..... G03C 1/78

[52] U.S. Cl. ..... 430/534; 430/531; 430/532; 430/533; 430/535; 430/537

[58] Field of Search ..... 430/532, 533, 534, 535, 430/536, 537, 538, 539, 531

[56] References Cited

U.S. PATENT DOCUMENTS

| | | | |
|---|---|---|---|
| 3,533,795 | 10/1970 | Blaumueller | 430/534 |
| 3,567,452 | 3/1971 | Rawlins | 430/534 |
| 4,124,395 | 11/1978 | Ochiai et al. | 430/534 |

*Primary Examiner*—Jack P. Brammer

*Attorney, Agent, or Firm*—James Magee, Jr.

[57] ABSTRACT

Adhesion of a hydrophilic photographic emulsion to a hydrophobic polyester substrate is achieved by providing the substrate with a surface layer containing free carboxy groups and incorporating in the emulsion a cross-linking agent which can cross-link the emulsion and the carboxy containing surface layer. Carbodiimides are a class of cross-linking agents having this capability.

8 Claims, No Drawings

IN PHOTOGRAPHIC EMULSION ADHESION TO A POLYESTER FILM BASE

This invention relates to photographic films and to methods for improving the adhesion of a hydrophilic photographic emulsion to a polyester substrate, and especially to methods for improving the adhesion of gelatin-containing photographic emulsions to dimensionally stable polyethylene terephthalate film base substrates and also to the resulting composite films and to photographic materials characterized by improved adhesion obtained by the practice of this invention.

BACKGROUND OF THE INVENTION

It is well known that self-supporting films formed of synthetic linear polyesters, particularly the polyesters formed by the reaction of ethylene glycol with terephthalic acid, may be prepared in such a manner that they have mechanical and physical and chemical properties which render them highly suitable for use as base materials or substrate materials on which can be coated silver halide photographic emulsions.

A large number of self-supporting film materials are known as supporting substrates for photographic film. Generally, such materials are essentially hydrophobic in character and many are highly hydrophobic. Considerable difficulty is often encountered in providing adequate adhesion of the hydrophilic emulsion to the hydrophobic substrate. Strong adhesion is absolutely necessary in view of the physical and chemical processing to which the photographic film is subjected.

In order to provide adequate adhesion of a hydrophilic layer, such as a gelatin silver halide emulsion to a polyester film, it is known to provide intermediate layers of varying hydrophilicity between the substrate and the photographic emulsion. In many cases, a plurality of intermediate layers are employed. A first layer, generally characterized by good adhesion to the polyester film, is frequently referred to as the priming layer. A second layer, called a subbing layer and usually containing a substantial amount of a hydrophilic collodial material, such as gelatin, is coated onto the priming layer. The photographic emulsion layer is then coated on the subbing layer. It is generally believed, and therefore the practice in the industry, that good adhesion of the photographic emulsion layer to the hydrophobic film surface can only be obtained when the surface of the hydrophobic material has been properly primed and subbed with an intermediate layer or layers containing a sufficient amount of a hydrophilic material.

It is an object of this invention to provide methods and materials for improving the adhesion of a gelatin-containing photographic emulsion to a hydrophobic film base or substrate, particularly to polyester substrates.

Another object of the invention is to provide photographic elements having a gelatin-containing silver halide emulsion which elements are characterized by improved adhesion of the emulsion to the film base.

A further object of the invention is to provide photographic elements having a hydrophobic film base and a hydrophilic photographic emulsion characterized by improved adhesion without need for conventional priming and subbing layers having varying degrees of hydrophobicity.

A more specific object being to eliminate the need for intermediate subbing layers containing gelatin as a hydrophilic material.

SUMMARY OF THE INVENTION

These and other related objects are achieved by providing a film base characterized by active sites such as carboxyl groups which can be cross-linked by means of suitable hardening agents with the amine groups of the gelatin matrix of the photographic emulsion. Such active sites can be provided by suitable treatment of the film base surface, e.g., by flame, electrical discharge, and preferably by chemical treatment with a polymeric material containing free carboxy functional groups. Such polymers are well known in the polymer art and can be prepared by conventional methods.

Treatment of film base by flame and electrical discharge are also well known in the art and, hence, require no further description.

The term "cross-link" as used herein, refers to chemical reaction between the gelatin amino groups and the carboxy groups associated with the substrate or film base, either directly, as a result of physical treatment of the base with some form of energy, such as corona discharge; or indirectly, such as by coating the base with a primary layer of a carboxy-containing polymeric material.

Good adhesion of the photographic emulsion layer without multiple intermediate gelatin-containing subbing layers is achieved by providing the film base substrate with a primary layer of a polymer coating securely bonded to the polyester film said polymer layer containing free carboxylic acid groups which provide reaction sites for cross-linking with the gelatin amino groups of the photographic emulsion layer in the presence of a relatively fast-acting, cross-linking agent. The preferred cross-linking agent for chemically bonding the polymer and the emulsion layers is a carbodiimide, although other cross-linking agents can be used as long as they are photographically compatible and capable of cross-linking the active sites of the polymer and gelatin. Cross-linking agents may be used in conjunction with conventional tanning or hardening agents such as formaldehyde or glutaraldehyde commonly used to harden the gelatin matrix of a photographic emulsion.

The practice of this invention provides a simplified process for preparing photographic films by elimination of the conventional subbing operation heretofore employed to prepare a polyester substrate to receive and retain the aqueous photographic gelatin-containing emulsion, which after drying, must evidence sufficient adherence to the substrate to withstand dry and wet handling in acid and alkaline media, as well as processing and drying conditions in the manufacturing operation.

Accordingly, the process of the invention comprises applying to the film base, e.g., dimensionally stable polyester film substrate, a single polymeric layer containing from about 1 to about 10% by weight, and preferably about 2–4% free carboxyl groups. The polymeric material can be a simple polymer, a copolymer containing two or more monomers, or a mixture of polymeric materials. Illustrative copolymers include ethyl acrylate-methyl methacrylate-acrylic acid; styrene-methyl acrylate; ethyl acrylate-styrene-itaconic acid.

Cross-linking between the amino groups of the gelatin emulsion and the carboxy groups of the surface polymer is achieved by the action of a cross-linking or hardening agent which can be introduced by incorporation in the emulsion, or by other convenient means conventional in the industry. It is important that an adequate amount of cross-linking agent be present at the interface between the carboxy-containing layer and the emulsion layer application of the emulsion layer to effect cross-linking in addition to any such agent involved in hardening the emulsion.

Carbodiimides suitable for use in this invention have the formula R—N=C=N—R wherein each R can be a monovalent organic residue containing from 1 to about 20 carbon atoms. The carbodiimides can be symmetrical or asymmetrical, aliphatic or aromatic. Aliphatic and aromatic groups present in the carbodiimide structure can be substituted with one or more of the following groups: halogen, cyano, nitro, amino, alkyl amino, alkoxy and the like. Illustrative carbodiimide cross-linking agents include:

N-methyl-N'-propyl-carbodiimide
N-ethyl-N'-propyl-carbodiimide
N,N'-diisopropyl-carbodiimide
N,N'-di-n-butyl-carbodiimide
N,N'-di-allyl-carbodiimide
N,N'-di-cyclohexyl-carbiimide carbodiimide
N-(3-dimethylaminopropyl)-N'-ethyl-carbodiimide hydrochloride
N,N'-di (p-dimethylaminophenyl)-carbodiimide
N,N'-di (triphenylmethyl)-carbodiimide
N,N'-di-p-tolyl-carbodiimide The carbodiimide agent is believed to react with the carboxylic acid groups of the polymeric layer and the amino groups of the gelatin to form, ultimately, an amide linkage. The reaction may be illustrated by the following reaction scheme:

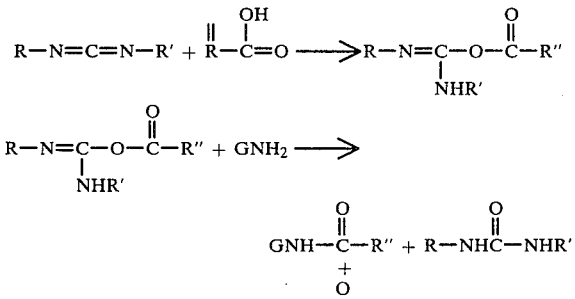

In the above formula, $GNH_2$ represents the gelatin amino groups and R and R' are substituents on the carbodiimide which can be selected to promote stability. R'' represents the chain of repeating structural units of the polymer which is coated on the surface of the substrate.

Other illustrative cross-linking agents include morpholinocarboxyl pysidinium chloride, ethyleneglycoldiglycidyl ether, and isoxazolium salts.

In the practice of the invention, the free-acid polymeric material can be a polymer or mixture of polymers which is prepared by processes known to those in the art, the proportion of selected monomers varying in accordance with desired properties of the final film product. Illustrative formulations for the carboxy-containing polymer are set forth below in Table I.

TABLE I

| Polymer | Components | Amount |
|---|---|---|
| A | Ethyl acrylate | 41% |
| | methyl methacrylate | 55% |
| | acrylic acid | 4% |
| B | Styrene | 75% |
| | methyl acrylate | 25% |
| C | Tallow fatty acid | 50% |
| | polyethyl and polymethyl acrylate | 50% |
| D | Ethyl acrylate | 75% |
| | styrene | 20% |
| | itaconic acid | 5% |

The polymeric material can be applied to the substrate by any conventional coating technique, preferably in the form of a latex. The aqueous phase can be removed by evaporation during the manufacturing process. The thickness of the polymeric layer is not narrowly critical as long as it provides carboxy functional groups for cross-linking and is compatible with the ultimate use of the film.

The carbodiimide can be admixed with the gelatin emulsion, otherwise standard in composition, immediately prior to coating in order to avoid premature hardening of the gelatin. In general, sufficient carbodiimide is used in order to provide enough cross-linking between the gelatin and the carboxy-containing polymer to assure good adhesion. It is preferred that the carbodiimide be side-streamed into the gelatin coating material as it is being applied to the film base in amount sufficient to effectively cross-link the amino groups and the carboxy groups to provide optimum adhesion.

In order to illustrate the principles and the practice of this invention, a silver halide-containing emulsion comprising gelatin, silver halide, water and conventional surfactants, stabilizers and antifogging agents was prepared and coated onto a polyester film base having a surface-modifying polymer coating thereon. The polymer coating was applied in the form of a latex (approximately 3% solids) in aqueous media. The latex was applied by reverse roll coatings at a depth of less than 1 micron. The coated film base was dried to remove all or nearly all of the water. The dried film was then coated with the gelatin-silver halide emulsion formulation to which the carbodiimide cross-linking agent, 1-n-butyl-3-[(dimethylamino)propyl] carbodiimide hydrochloride was added immediately before coating. The cross-linking agent was added at the rate of 1 gram per 250 ml of emulsion. The coating formulation was spread on the film by drawing a no. 28 wound wire rod along the surface. The coated samples were allowed to set for several minutes and then dried at 100° F. in a forced air oven for 30 minutes before testing for adhesion according to the procedures described below. A series of carboxyl-containing polymers containing ethyl acrylate and styrene in a weight ratio of 65 to 35 and varying amounts of itaconic acid ranging from from 0 to about 7.5 parts by weight, as well as one polymer comprising ethyl acrylate, methyl methacrylate and itaconic acid (65/35/7.5) were used to illustrate the effect of the polymer in modifying the film base surface and promotion of adhesion.

ADHESION TESTING PROCEDURES

Dry Adhesion—Several lines are scribed into the emulsion to form a triangle. No. 600 Scotch tape is separately applied to each of the three legs and pulled up sharply. The amount of emulsion removed is measured by comparison with GAF standards. A "1" rating means no emulsion was removed and a "5" rating means that nearly all the emulsion was removed.

Wet Adhesion—The sample is processed through normal GAF SC-90 chemistry as follows: place in developer for 25 seconds followed by 15 seconds in the fixer and finally 10 seconds in a water wash. A $ sign is scribed into the wet emulsion with a Gestetner SPB12 stylus (English). The wet sample is placed on a flat surface (glass) and the $ sign is rubbed with 3–5 pounds of pressure using the edge of a #7 rubber stopper. The amount of emulsion removal is compared to standard samples and samples are rated 1 to 5. Number 1 is excellent whereas 5 is almost complete failure.

Dry Developed Adhesion—The wet adhesion samples from part (b) are dried and then the dry adhesion procedure outlined in part (a) is followed. The samples are rated as in part (a).

The adhesion properties of the emulsion coating hardened by formaldehyde and the carbodiimide are set forth in Table II, below.

TABLE II

Adhesion Properties of Hardened Emulsion Coatings on a Polymeric Layer Having Increased Carboxyl Content

| | $CH_2O$ Hardener | | | CDI Hardener | | |
|---|---|---|---|---|---|---|
| | Wet[1] | Wet[2] | Dry | Wet[1] | Wet[2] | Dry |
| EA/ST/IA/(65/35/0) | 5 | 5 | 5 | 5 | 4 | 3 |
| EA/ST/IA(65/35/1.25) | 5 | 5 | 5 | 5 | 4.5 | 2.5 |
| EA/ST/IA/(65/35/2.5) | 5 | 5 | 5 | 2.5 | 3 | 1 |
| EA/ST/IA(65/35/5.0) | 5 | 5 | 5 | 2 | 1.5 | 1 |
| EA/ST/IA(65/35/7.5) | 5 | 5 | 5 | 1.5 | 2.5 | 1 |
| EA/MMA/IA(65/35/7.5) | 2 | 5 | 5 | 1.5 | 2 | 1 |

[1]$H_2O$
[2]Photographic processing solution containing gultraldehyde hardener

What is claimed:

1. A photographic film element comprising a gelatin-containing silver halide emulsion chemically cross-linked to a hydrophobic film base substrate having active functional group sites which are cross-linked with the amino groups of the gelatin by a carbodiimide cross-linking agent.

2. The photographic element of claim 1 wherein the active sites are carboxyl groups of a polymeric coating carried on the film base surface.

3. A multilayer photographic film element comprising a dimensionally stable polyester support layer, a primary layer coated on the support layer, said primary layer comprising a polymeric material having reactive carboxy groups cross-linked to a gelatin silver halide emulsion layer by means of a carbodiimide.

4. A photographic element according to claim 3 comprising a polyester support, a prime layer on said support comprising a polymeric material having reactive free carboxyl groups, and a gelatin silver halide photographic emulsion layer containing carbodiimide and bonded to said prime layer by amide linkages formed between said free carboxy groups and the carbodiimide.

5. A process for improving the adhesion of a hydrophilic photographic emulsion layer to a hydrophobic film base which comprises:

a. providing the film base with functional sites of cross-linking with the emulsion layer under the influence of a cross-linking agent, and
b. incorporating in said emulsion a cross-linking effective amount of a carbodiimide.

6. The process according to claim 5 for improving the adhesion of a gelatin-silver halide emulsion to a polyester substrate which comprises:

a. providing the polyester substrate with a primary layer consisting of a polymeric material having free reactive carboxy groups;
b. incorporating in said emulsion a cross-linking effective amount of a carbodiimide.

7. The process of claim 6 wherein the carboxyl-containing polymer is characterized by the presence of from about 2 to about 5 weight percent free carboxyl groups, and said emulsion contains an amount of carbodiimide sufficient to cross-link the carboxy groups with the amino groups of the gelatin.

8. A process according to claim 6 for improving adhesion of a gelatin-silver halide emulsion layer to a polyester film base substrate which comprises incorporating in said emulsion a cross-linking amount of a carbodiimide hardener and providing said substrate with a primary layer containing reactive free carboxyl groups.

* * * * *